United States Patent [19]

Lecinski, Jr. et al.

[11] Patent Number: 4,603,786

[45] Date of Patent: Aug. 5, 1986

[54] PRESS-ON CLOSURE FOR RESEALABLE GLASS FINISH

[75] Inventors: Frank H. Lecinski, Jr., Harwood Heights; William J. Thomas, Bolingbrook, both of Ill.

[73] Assignee: Continental White Cap, Inc., Northbrook, Ill.

[21] Appl. No.: 719,160

[22] Filed: Apr. 2, 1985

[51] Int. Cl.[4] ..... B65D 53/00

[52] U.S. Cl. ..... 215/318; 215/346; 215/348

[58] Field of Search ..... 215/318, 346, 348

[56] References Cited

U.S. PATENT DOCUMENTS 3,690,497 9/1972 Lecinski ..... 215/346 X

*Primary Examiner*—Donald F. Norton

*Attorney, Agent, or Firm*—Charles E. Brown

[57] ABSTRACT

A closure of the press-on type which includes a shell having therein a liner which functions to both form a seal with a container neck finish and also to form in the closure threads which are complementary to the threads of a container neck finish wherein although the closure is pressed on, it may be removed by rotating the same and further may be reapplied to have the same original tight seal. The closure is particularly identifiable by the properties and dimensions of the liner with the properties including a percent puff range and a hardness and the dimensions including certain critical dimensions as to liner thickness.

18 Claims, 3 Drawing Figures

PRESS-ON CLOSURE FOR RESEALABLE GLASS FINISH

This invention relates in general to new and useful improvements in closures for containers, and more particularly to a closure of the press-on type having a flowable plastisol liner which when pressed onto a threaded container neck finish will flow and wherein the threads of the neck finish will form in the liner permanent threads which permit the rotational removable of the closure and the resealing of the container by rotationally reapplying the closure.

Closures of this general type are known. However, it has been found that there is a particular correlation between the physical properties of the plastisol compound and the resultant opening torque and strip torque.

Most particularly, it has been found that when the percent puff, which is defined as:

(unpuffed denisty − puffed density)/puffed density has a range of 50 to 80% combined with a Shore "A" hardness range of 50–70, the most desirable torque characteristics are obtained.

With the above and other objects in view that will hereinafter appear, the nature of the invention will be more clearly understood by reference to the following detailed description, the appended claims, and the several views illustrated in the accompanying drawings.

Figure 1:
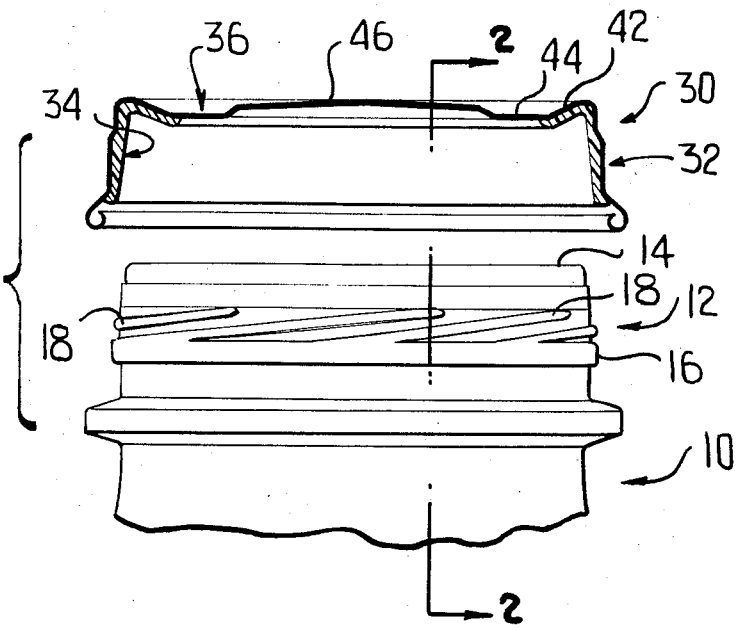
FIG. 1 is a fragmentary exploded view showing an upper portion of a container having a thread construction particularly adapted for use with a press-on type closure, and a closure formed in accordance with this invention, and the closure being shown in section.

Referring now to the drawings in detail, it will be seen that there is illustrated in FIG. 1 a glass container, generally identified by the numeral 10 which may be in the form of a jar or bottle. The container 10 has a threaded neck finish 12 which terminates in an end sealing surface 14.

Figure 2:
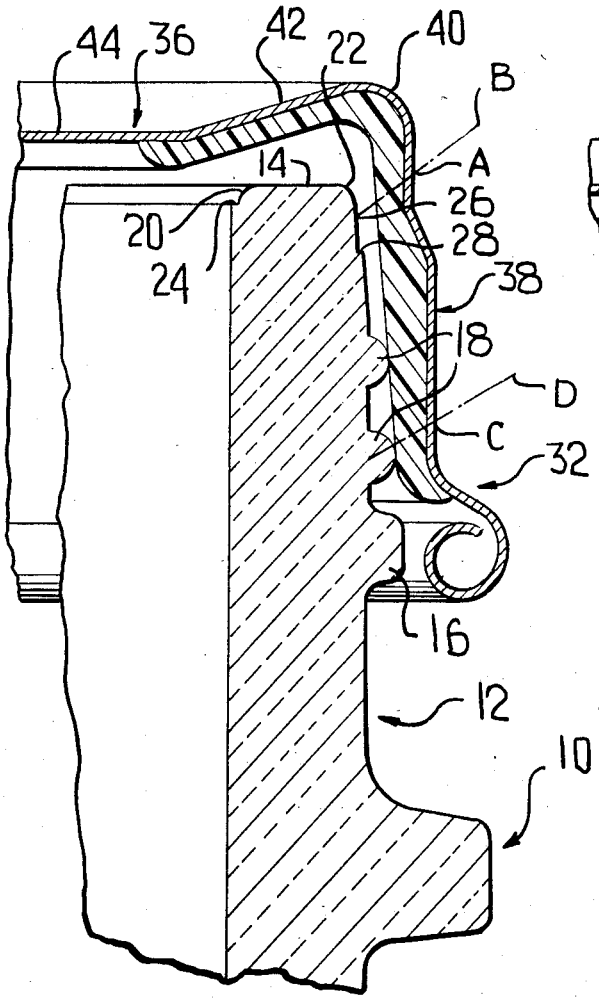
FIG. 2 is an enlarged fragmentary sectional view taken generally along the line 2—2 of FIG. 1 but with the closure partially telescoped over the container neck finish.
Figure 3:
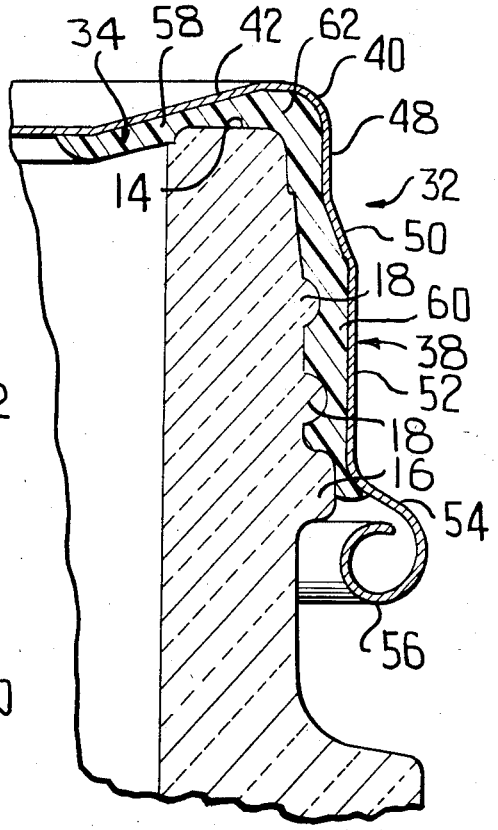
FIG. 3 is an enlarged fragmentary sectional view similar to FIG. 2 but showing the closure fully applied and the plastisol compound liner thereof having flowed around the neck finish threads to form complementary threads within the liner.

The neck finish 12, which is of a slightly tapered arrangement as is best shown in FIG. 2, includes a base ring or bead 16 which has extending therefrom at circumferentially spaced intervals thread segments 18.

Referring particularly to FIG. 2, it will be seen that the end sealing surface 14 has rounded corner portions 20, 22 with the corner portion 20 terminating in an internal shoulder 24 and the corner portion 22 terminating in a downwardly flaring surface 26 which in turn terminates in a shoulder 28.

While the illustrated neck finish 12 includes interrupted or lug type threads, it is to be understood that the threads 18 could be in the form of a continuous thread.

This invention particularly relates to the closure which is to be associated with the neck finish 12, the closure being generally identified by the numeral 30. The closure 30 is in the form of a shell, which is generally identified by the numeral 32 and a liner within the shell, the liner being generally identiefied by the numeral 34. The shell 32 is preferably formed of metal.

The shell 32 basically includes an end panel 36 and a depending skirt 38. The end panel is joined to the skirt by a rounded corner 40.

It will be readily apparent from FIG. 2 that the end panel 36 has an outer radially inwardly and axially downwardly sloping portion 42 which extends from the rounded shoulder 40 and is connected to an annular portion 44. The end panel 36 also has a raised central portion 46 which is surrounded by the annular portion 44 with the raised portion being, if so desired, in the form of a button.

The skirt 38 is generally of a stepped construction and includes an upper cylindrical portion 48 which is joined to the rounded shoulder 40 and extends downwardly therefrom. The cylindrical portion 48 terminates in a radially outwardly flared portion 50 which, in turn, terminates in a lower cylindrical portion 52. The lower cylindrical portion 52 terminates in a radially outwardly and axially downwardly flared portion 54 which, in turn, terminates in a radially inwardly directed curl 56.

The liner 34 includes an upper end seal portion 58 and a thread forming portion 60. The portions 58 and 60 are joined by a corner portion 62. The end seal forming portion 58 extends from the corner of the shell 32 in underlying relation to the portion 42 and terminates under the radially outer part of the portion 44. The thread forming portion 60 extends substantially the full height of the skirt 38 and terminates in the portion 54.

At this time it is pointed out that the details of the shell 58 are basically old and that this invention primarily relates to the liner 34.

In all testing utilizing neck finishes of the type illustrated in the drawings and press-on closures of the general type described hereinabove, it was found that the "conventional" closure lacked certain characteristics and physical shape in order that it function as required and desired. Accordingly, much effort was put forth in the compound or plastisol shape and characteristics in order that (1) cap application is satisfactory, especially under very hot fill temperatures whereby very little package vacuum exists, (2) the closure withstand a certain amount of abuse in the laboratory without losing vacuum (breaking the seal between the closure liner and the end surface of the container neck finish) which simulates a sealed package going through its life cycle to the store shelf, to the grocery cart, (3) the opening torque be acceptable (as a general guide the opening torque would be one half the millimeter size of the closure), and (4) since reuse is expected, that is, when the container contents are not consumed at one opening, the closure is resealed on the container finish by proper engagement of the closure to the threaded neck finish and tightened until a perceived proper level of tightness is experienced. The level of tightness is measurable and is referred to as "strip" torque. With respect to this, twist-lug style closures and continuous thread closures typically formulated the background experience for the ultimate consumer to judge ease of reseal or engagement of the closure to the container finish and also the perceived proper reseal to some reapplication torque level that is then recognized as the level where the person reapplying the closure automatically stops the reapplication process without stripping the closure on the container finish.

In order to obtain the proper cap application, acceptable opening torques, upon reseal, good closure to container finish engagement and a high enough reseal torque (strip torque) without closure stripping, it was found in accordance with this invention that in addition to the glass finish contour improvement, such as that of the neck finish 12 of FIG. 1, the plastisol compound which forms the liner 34 has to have certain physical properties and geometric shapes.

More particularly, proper strip torques (maximum level of tightness) are obtained when percent puff and Shore "A" hardness are within specific ranges and the plastisol compound dimension is within specific limits.

Among other requirements, the strip torque value must be equal to or greater than the opening torque or conversely, the opening torque must be equal to or less than the strip torque.

Liners formed in accordance with this invention are formed of plastisol compounds made from a plasticized polyvinyl chloride that contains pigment, lubricants, and stabilizers suitable for use with the products to be packed.

Most specifically, in accordance with this invention, the plastisol compound utilized in forming the liner 34 must have a closed cell foam structure with a percent puff range of 50–80% combined with a Shore "A" hardness range of 50–70.

Percent puff is defined as:

(unpuffed density − puffed density)/puffed density

Plastisol compounds containing lubricants such as fatty acid amides and/or paraffin waxes at a level to produce desirable opening torques and desirable reapplication torques have been found to be most useful.

It is to be understood that the liner 34 is formed by shaping the plastisol compound by molding by a "smooth wall" molding punch. The final percent level of puff is achieved during the plastisol compound curing process. Most particularly, with reference to FIG. 2, the liner has critical thicknesses. At a point A located 0.060 inch down from the top of the liner 32, and along a line B which intersects the shell at point A and slopes downwardly and radially inwardly at an angle 25° to the horizontal, the thickness of the liner should be a minimum of 0.030 inch and a maximum of 0.070 inch. Also, at a point C located 0.265 inch from the top of the shell 32 and along a line D sloping radially inwardly and downwardly at an angle of 25° to the horizontal, the thickness of the liner should be a minimum of 0.007 inch and a maximum of 0.040 inch.

The following data relating to opening and strip torques is typical of those obtained from various laboratory tests utilizing the closure formed in accordance with this invention.

| | |
|---|---|
| 51 mm DATA | |
| Test Q-427 - Three Month Old Samples | |
| Opening Torque (Range): | 21–30" lbs. |
| (Average): | 26.8 |
| Strip Torque (Range): | 27–30" lbs. |
| (Average): | 29.5 |
| Test Q-416 - Three Month Old Samples | |
| Opening Torque (Range): | 27–32" lbs. |
| (Average): | 30 |
| Strip Torque (Range): | all 30+ |
| Test Q-263 - One Month Old Samples | |
| Opening Torque (Range): | 20–32" lbs. |
| (Average): | 27.3 |

-continued

| | |
|---|---|
| Strip Torque (Range): | 32–50" lbs. |
| (Average): | 44.5 |
| 48 mm DATA | |
| Test N-285 - One Month Old Samples | |
| Opening Torque (Range): | 20–30" lbs. |
| (Average): | 24.7 |
| Strip Torque (Range): | 43–50" lbs. |
| (Average): | 49.5 |
| Test N-323 - Three Month Old Samples | |
| Opening Torque (Range): | 19–34" lbs. |
| (Average): | 27.4 |
| Strip Torque (Range): | 35–41" lbs. |
| (Average): | 38.8 |
| Test Q-40 - Six Month Old Samples | |
| Opening Torque (Range): | 25–29" lbs. |
| (Average): | 29.6 |
| Strip Torque (Range): | 33–60" lbs. |
| (Average): | 40.6 |
| 63 mm DATA | |
| Test Q-422 - One Month Old Samples | |
| Opening Torque (Range): | 22–27" lbs. |
| (Average): | 23.4 |
| Strip Torque (Range): | 38–44" lbs. |
| (Average): | 41.1 |

Although only preferred ranges of the plastisol compound which is utilized as a liner in accordance with this invention have been specifically described, it is to be understood that minor variations may be made in the closure which is the subject of this invention without departing from the spirit and scope of the invention as defined by the appended claims.

We claim:

1. A resealable press-on closure for containers of the type having a neck finish including threads, said closure comprising a shell including an end panel and a depending skirt, and a plastisol compound liner extending a major portion of said skirt and at least partially across said end panel, said liner including an end seal portion and a thread forming portion, said closure being improved by said plastisol compound being a closed cell foam structure having a related percent puff range and hardness ratio wherein when said closure is applied a thread impression will be formed in the said compound thread forming portion wherein a resultant opening torque will be equal to or less than a reapplication strip torque, said percent puff ranging between 50 and 80%, and said hardness having a Shore "A" hardness range of between 50 and 70.

2. A closure according to claim 1 wherein said percent puff is on the order of 65%.

3. A closure according to claim 2 wherein said Shore "A" hardness is on the order of 60.

4. A closure according to claim 1 wherein said Shore "A" hardness is on the order of 60.

5. A closure according to claim 1 wherein the thickness of said compound in an upper part of said thread forming portion ranges between 0.030 and 0.070 inch.

6. A closure according to claim 1 wherein the thickness of said compound in a lower part of said thread forming portion ranges between 0.007 and 0.040 inch.

7. A closure according to claim 1 wherein the thickness of said compound in an upper part of said thread forming portion ranges between 0.030 and 0.070 inch when taken at a radially inwardly and axially downwardly sloping angle of 25° to a center axis of said closure.

8. A closure according to claim 1 wherein the thickness of said compound in a lower part of said thread forming portion ranges between 0.007 and 0.040 inch and the thickness of said compound in an upper part of said thread forming portion ranges between 0.030 and 0.070 inch when taken at a radially inwardly and axially downwardly sloping angle of 25° to a center axis of said closure.

9. A closure according to claim 1 wherein the thickness of said compound in an upper part of said thread forming portion ranges between 0.030 and 0.070 inch and the thickness of said compound in a lower part of said thread forming portion ranges between 0.007 and 0.040 inch.

10. A closure according to claim 1 wherein the thickness of said compound in an upper part of said thread forming portion ranges between 0.030 and 0.070 inch and the thickness of said compound in a lower part of said thread forming portion ranges between 0.007 and 0.040 inch when taken at a radially inwardly and axially downwardly sloping angle of 25° to a center axis of said closure.

11. A resealable press-on closure for containers of the type having a neck finish including threads, said closure comprising a shell including an end panel and a depending skirt, and a plastisol compound liner extending a major portion of said skirt and at least partially across said end panel, said liner including an end seal portion and a thread forming portion, said closure being improved by said plastisol compound being a closed cell foam structure having a puff percent range of 50 to 80%.

12. A closure according to claim 11 wherein an optimum puff percent is on the order of 65%.

13. A closure according to claim 11 wherein said compound has a Shore "A" hardness range of between 50 and 70.

14. A closure according to claim 13 wherein said compound has a related percent puff range and hardness ratio wherein when said closure is applied a thread impression will be formed in the said compound thread forming portion wherein a resultant opening torque will be equal to or less than a reapplication strip torque.

15. A closure according to claim 13 wherein an optimum puff percent is on the order of 65%.

16. A closure according to claim 13 wherein an optimum hardness is 60 Shore "A".

17. A resealable press-on closure for containers of the type having a neck finish including threads, said closure comprising a shell including an end panel and a depending skirt, and a plastisol compound liner extending a major portion of said skirt and at least partially across said end panel, said liner including an end seal portion and a thread forming portion, said closure being improved by said plastisol compound being a closed cell foam structure having a Shore "A" hardness range of between 50 and 70.

18. A closure according to claim 17 wherein an optimum hardness is 60 Shore "A".

* * * * *